United States Patent [19]

Staat et al.

[11] 4,277,967

[45] Jul. 14, 1981

[54] PUSH BENCHES

[75] Inventors: Karl-Hans Staat, Bad Homberg/Ratingen; Theodor Zacharias, Meerbusch; Bernhard Terdenge, Düsseldorf, all of Fed. Rep. of Germany

[73] Assignee: Kocks Technik GmbH & Co., Düsseldorf, Fed. Rep. of Germany

[21] Appl. No.: 958,808

[22] Filed: Jan. 31, 1979

[30] Foreign Application Priority Data

Nov. 30, 1977 [DE] Fed. Rep. of Germany ..... 2753267

[51] Int. Cl.[3] ..... B21B 13/10

[52] U.S. Cl. ..... 72/224

[58] Field of Search ..... 72/224, 237, 238, 225, 72/235; 29/445, 148.4 R; 76/107 A

[56] References Cited

U.S. PATENT DOCUMENTS

| | | | |
|---|---|---|---|
| 3,142,708 | 7/1964 | Properyl et al. | 72/224 X |
| 3,987,657 | 10/1976 | Properyl et al. | 72/224 |

*Primary Examiner*—Milton S. Mehr

*Attorney, Agent, or Firm*—Buell, Blenko, Ziesenheim & Beck

[57] ABSTRACT

The rollers of a push bench for the production of tubular blooms are axially displaceably journalled on respective spindles so that the rollers are centered by the bloom. For machining the working surfaces of the rollers, the rollers, or their shafts to which they are fixed, can be axially locked in position and the roller shaft has a releasable coupling for coupling the roller shaft to a drive motor or drive shaft, whereby all the rollers can be machined simultaneously without removing them from the stand.

6 Claims, 4 Drawing Figures

PUSH BENCHES

The invention relates to improvements in push benches and particularly to a push bench for the production of tubular blooms, in which push bench roller stands are arranged axially one behind the other, in each of which roller stands several rotatably journalled rollers commonly form a sizing pass.

The rollers in known push benches have axial bearing play, transversely of the run-through direction of the tubular bloom, relative to the roller stands. This is because experiments have shown that axial fixing of these rollers by means of, for example, axial bearings, only leads to the early destruction of the axial bearings and is thus the cause of high costs without obtaining any detachable improvement in the quality of the tubular blooms. The reason for the destruction of the axial bearings is that the mandrel rod forces the rollers into a sepcific axial position (centering effect) upon impact with the tubular bloom, and the axial forces thereby occurring are so great that existing axial bearings of structurally justifiable size, which oppose this centering effect, are destroyed.

In the known push benches, the rollers which, for the reason given above, are axially displaceable by a limited amount within the roller stands, are removed from the roller stands for the purpose of machining their working surfaces, that is for the cutting of the contour of the sizing passes, and are individually machined on a metal-cutting machine tool suitable for this purpose. Such removal of the rollers from the roller stands and the subsequent refitting of the rollers are necessary since, owing to the axial bearing play of the rollers in the roller stands, the rollers cannot be machined in a fitted state. The rollers would yield to the cutting pressure of the tool in an axial direction and one would obtain a completely indeterminate and undesired sizing pass contour which would be completely unserviceable in most cases.

Therefore, with the known types of construction, one is forced to remove the rollers before machining and then to refit them again, thus involving the substantial disadvantage of a considerable expenditure of labor and time. The relevant roller stand is also inoperative for a correspondingly long period of time. A further disadvantage is that, in the known types of construction, an accurately symmetrical configuration of the sizing pass cannot be obtained in the individual roller stands, since the rollers forming a sizing pass cannot be commonly machined and even small, unavoidable irregularities, for example, when clamping the individual rollers in the finishing machine or during the machining itself, cause non-uniformities between the rollers forming a sizing pass and, consequently, form a sizing pass of unsymmetrical configuration, which, of course, has a disadvantageous effect upon the deformation operation and the quality of the resulting tubular bloom.

An object of the present invention is to provide a push bench for the production of tubular blooms which does not have the disadvantages discussed above and in which it is possible rapidly to obtain an accurately symmetrically formed and accurately dimensioned sizing pass.

the present invention provides a push bench for the production of tubular blooms having roller stands which are arranged axially one behind the other and in each of which a sizing pass is defined by a plurality of rotatably journalled rollers which have axial play, relative to the roller stands and directed transversely of the run-through direction of the tubular bloom, in which the rollers and the shafts carrying them are journalled in the roller stands so as to be temporarily free from axial play during machining of the working surfaces of the rollers, and in which at least one end portion of each roller shaft has a coupling means which is suitable for transmitting torque and which is couplable to a motor and/or to a drive shaft so as to be non-rotatable relative thereto.

The rollers of the roller stands can thereby be machined in a fitted state, so that there is a saving on the considerable expenditure of work for removing and fitting the rollers. Many rollers stands are usually associated with a push bench, and each stand usually has three or more rollers, so that a total of more than 150 rollers are usually provided including the spare stands. Since all of these rollers have be machined repeatedly, there is a considerable saving on labor, time and costs by omitting the dismantling and assembly operations. The individual roller stands are also ready for use again more rapidly, and a further considerable advantage resides in the fact that, when machining the rollers in a fitted state, it is possible to machine the rollers commonly, thus to obtain a really symmetrical sizing pass configuration, this being advantageous with respect to the deformation operation and the quality of the tubular bloom.

The machining of the rollers in a fitted state is rendered possible by the features in accordance with the invention, since the rollers have to be driven during the machining operation, this being impossible with the known push benches, since the roller shafts are journalled within the roller stands and do not offer any possibility of coupling for the purpose of driving the rollers. It is now recognized by applicants that the arrangement of such coupling means offers considerable advantages, although only in connection with the further feature that the axial play of the rollers or of the shafts carrying them has to be temporarily eliminated, namely for the period during which the rollers are being machined. The latter is necessary in order to prevent the rollers from yielding to the tool and to obtain a sizing pass of satisfactory configuration.

There are many possibilities for driving the rollers or the roller shafts during the machining of the sizing pass. Thus, for example, each roller shaft can have an associated drive motor which is located in or on the roller stand. In accordance with a preferred feature of the invention, a drive motor of this type can be driven hydraulically or pneumatically. Motors of this type are particularly well suited for use in roller stands of push benches which are subjected to considerable impact and thermal stresses. The pressure medium can at the same time be used as a coolant and can be fed without any problems.

Although these drive motors are primarily intended for driving the rollers during machining of the sizing pass, it is, of course, also possible to admit pressure medium to the motors during the normal operation of the push bench in order to rotate the rollers even when a tubular bloom is not being pushed through the sizing passes. This has the substantial advantage that, when a tubular bloom is being pushed in, the bottom of the tubular bloom does not strike against stationary rollers and has to accelerate the latter only slightly or does not have to accelerate them at all. In this manner, the impact, to which the rollers are subjected when they are encountered by the tubular bloom, is substantially reduced.

In another embodiment of the invention, the roller shafts and their coupling means are drivable by drive shafts of a sizing pass finishing machine in a manner known in stretch-reducing rolling mills. In this embodiment, although one dispenses with the above-mentioned advantages of the drive motors, one obtains a very simple construction of the roller stands by omitting these motors.

It is particularly advantageous if the roller shafts and their roller are couplable without axial play to their associated drive shafts of a sizing finishing machine and are adjustable in an axial direction by means of the said drive shafts. This feature involves a further considerable simplification in the construction of the roller stands and, furthermore, their bearings can be constructed with considerable axial bearing play. This axial play is then only eliminated during the machining of the sizing passes, namely in that the the drive shafts of the sizing pass finishing machine retain the roller shafts in a specific axial position, preferably in a central position, so that after the sizing pass has been machined and after the drive shafts of the sizing pass finishing machine have been released from the roller shafts, the axial bearing play of the rollers is approximately equal to both sides. However, if unequal axial play is desired for special reasons, this can also be achieved by corresponding axial displacement of the drive shafts of the sizing pass finishing machine and thus also axial displacement of the roller shafts and rollers of the roller stand. This embodiment of the invention can also be realized when motors are fitted in the roller stands and the drive shafts of the sizing pass finishing machine then do not drive the rollers but are only required for fixing their axial position.

The invention includes a method of machining the rollers of push benches in which the rollers of a sizing pass are commonly machined in a state in which they are fitted in the roller stand.

In the foregoing specification we have set out certain preferred practices and embodiments of our invention; however, it will be understood that this invention may be otherwise embodied within the scope of the following claims.

The invention is illustrated in the drawings in one embodiment, in which.

Figure 1:
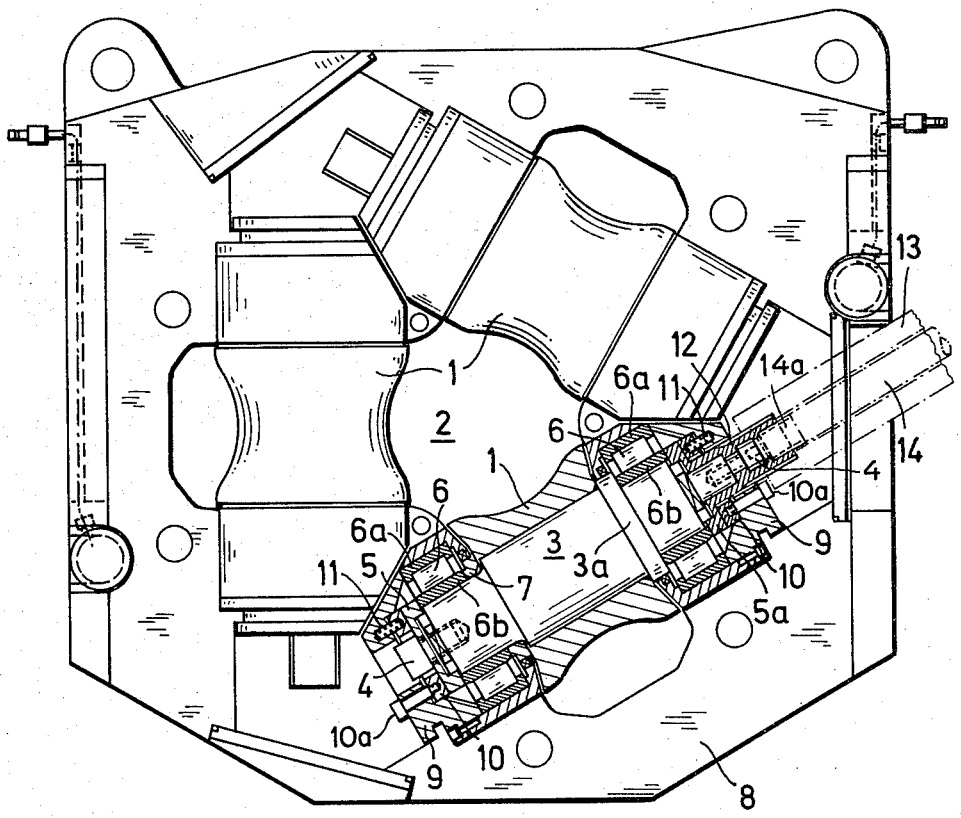
FIG. 1 is a front view of a roll stand partly in section.

In FIG. 1, there is illustrated a roll stand with three rolls 1, having their axes at 120° and forming a generally star shaped arrangement with a pass opening 2 receiving the tubular blooms from a push bar. The rolls 1 are each mounted on a roll shaft 3 which is journaled in roller bearing 6 on opposite sides of the roll. The bearing 6 on one side is mounted between a bolt 4 and compression ring 5 which bears on inner ring **6*b* of roller bearing 6 to force it against distance ring 7. The inner ring 6*b* of bearing 6 on the other side is similarly mounted between compression ring 5*a* and a shoulder 3*a* on shaft 3**.

The roll shaft 3 and with it roll 1 and bearing 6 are mounted in bearing housing frame 8. Each bearing 6 is protected by a bearing cover 9 surrounding the outer bearing ring **6*a*. Each of compression rings 5 and 5*a* is urged toward bearing ring 6*b* by pressure springs 11 acting on a pressure ring 10 which is held against rotation and is limited in axial motion by headed pins 10*a***.

The compression ring **5*a* is provided with a hollow axially extending coupling shaft 12 which extends out of housing 9. This coupling shaft 12 may be engaged by threaded coupling 14*a* on the end of hollow axial shaft 13 and by inner drive shaft 14 (shown in chain line in FIG. 1) when it is desired to drive roll 1 and shaft 3**.

Figure 2:
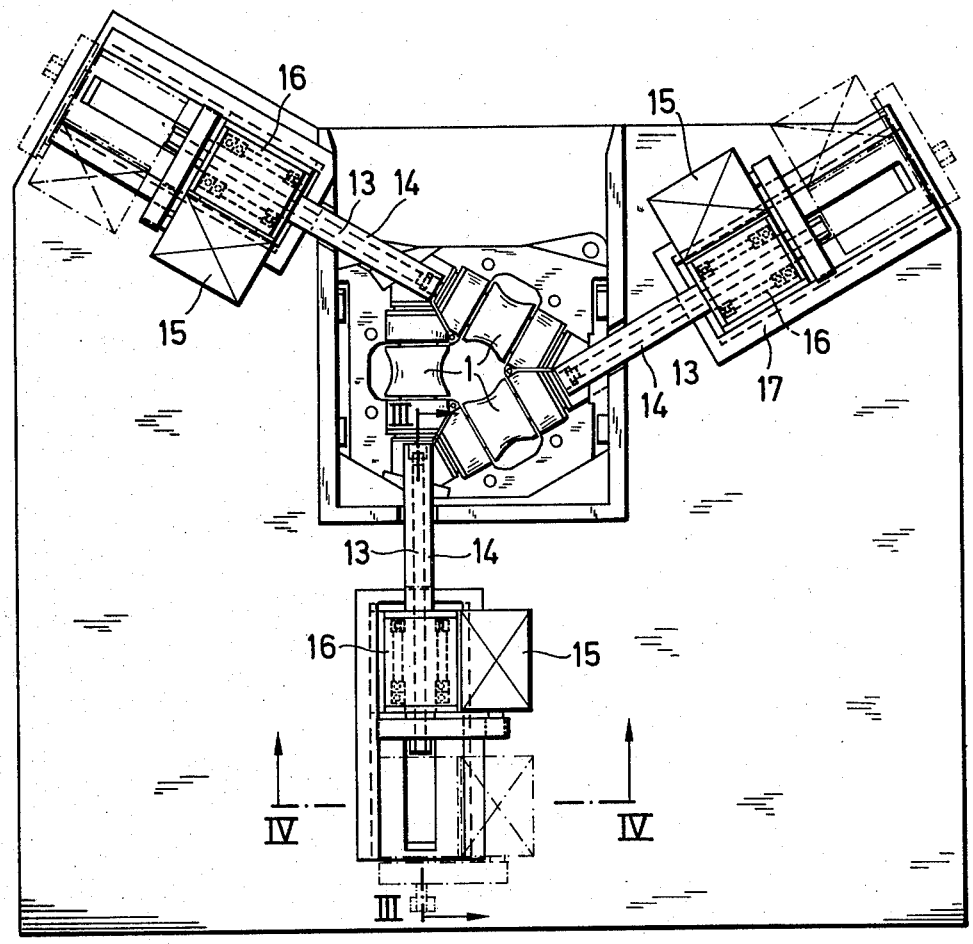
FIG. 2 is a roll stand according to FIG. 1 showing a sizing pass finishing apparatus.

In FIG. 2, there is illustrated a bearing housing 16 which carries tubular shaft 13, drive shaft 14 and drive motor 15 on guide 17. This assembly is movable from an inoperative position shown in chain line in FIG. 2 to an operative position shown in solid line. One such assembly is provided for each roll. When the assembly is in its inoperative position, roll 1 is free to rotate and to move axially to a limited extent on shaft 3. When the assembly is moved to its operative position (solid line on FIG. 2), the rolls are not free to move axially and are driven for rotation by motor 15 and shaft 14.

Figure 3:
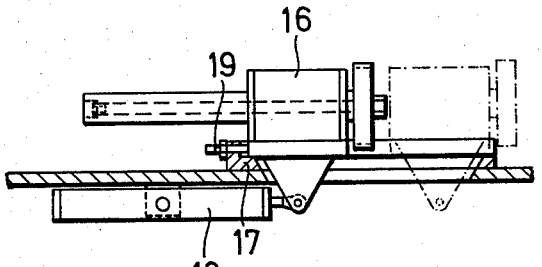
FIG. 3 is a section on the line III—III of FIG. 2.

In FIG. 3, there is illustrated a work cylinder 18 attached to housing 16 for moving it on guide 19 from the inoperative (chain line) to the operative (solid line) position and vice versa.

Figure 4:
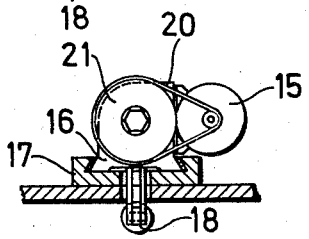
FIG. 4 is a section on the line IV—IV of FIG. 2.

FIG. 4 is a section through guide 17 showing the guide arrangement and connection for work cylinder 18 on housing 16.

We claim:

1. A push bench for the production of tubular blooms having roller stands arranged axially one behind the other along a pass line for said tubular blooms, a plurality of rollers rotatably journalled at each roller stand, defining a sizing pass, said rollers being axially movable relative to the pass line, means at each rollstand acting on said rollers selectively fixing them axially to prevent axial play, coupling means engaging said rollers for transmitting torque thereto when said rollers are fixed axially, and drive means selectively driving said coupling means and rollers.

2. A push stand as claimed in claim 1 wherein said roll stands carry a plurality of roll shafts equal to the number of rollers, said rollers being mounted on said roll shafts, said rollers and shafts being selectively rotatably journalled in said roll stands for axial movement relative to said roll stands and the pass line, and alternatively being axially fixed against axial movement, coupling means on at least one end of each shaft for transmitting torque thereto and drive means driving said coupling means.

3. A push bench as claimed in claim 2 in which each roller shaft has an associated drive motor which is located in or on the roller stand.

4. A push bench as claimed in claim 3 in which the drive motor is driven hydraulically or pneumatically.

5. A push bench as claimed in claim 2 in which the roller shafts and their coupling means are driven by drive shafts of a sizing pass finishing machine in a manner known in stretch-reducing rolling mills.

6. A push bench as claimed in claim 5 in which the roller shafts and their rollers are couplable without axial play to associated drive shafts, of a sizing pass finishing machine and are adjustable in an axial direction by means of the said drive shafts.

* * * * *

UNITED STATES PATENT AND TRADEMARK OFFICE

CERTIFICATE OF CORRECTION

PATENT NO. : 4,277,967

DATED : July 14, 1981

INVENTOR(S) : KARL-HANS STAAT, THEODOR ZACHARIAS and BERNHARD TERDENGE

It is certified that error appears in the above-identified patent and that said Letters Patent are hereby corrected as shown below:

Column 1, line 65, the first word "the" should be --The--.

Column 3, the entire paragraph on lines 42-46 inclusive, should be moved to column 4 and inserted between lines 29 and 30.

Column 4, line 9, before "threaded", --hollow axial shaft 13 and by-- should be inserted; same line after "of", "hollow axial shaft" should be deleted; line 10, "13 and by" should be deleted.

Signed and Sealed this

*Third* Day of *November 1981*

[SEAL]

*Attest:*

GERALD J. MOSSINGHOFF

*Attesting Officer* *Commissioner of Patents and Trademarks*